US005512911A

United States Patent [19]

Oprea

[11] Patent Number: 5,512,911

[45] Date of Patent: Apr. 30, 1996

[54] MICROWAVE INTEGRATED TUNED DETECTOR

[75] Inventor: Alexandru Oprea, Willowdale, Canada

[73] Assignee: Disys Corporation, Toronto, Canada

[21] Appl. No.: 239,454

[22] Filed: May 9, 1994

[51] Int. Cl.[6] ..... H01Q 1/38

[52] U.S. Cl. ..... 343/700 MS; 343/701

[58] Field of Search ..... 343/700 MS, 701; 455/327; H01Q 1/38, 1/26

[56] References Cited

U.S. PATENT DOCUMENTS

| | | | |
|---|---|---|---|
| 4,318,107 | 3/1982 | Pierrot et al. | 343/700 MS |
| 4,736,207 | 4/1988 | Siikarla et al. | 343/895 |
| 5,041,840 | 8/1991 | Cipolla et al. | 343/700 MS |
| 5,122,809 | 6/1992 | Haruyama et al. | 343/700 MS |

OTHER PUBLICATIONS

Reactive Tuning Improves Microwave Detector Performance, Microwaves & RF, Jul. 1991, pp. 79–82.

*Primary Examiner*—Michael C. Wimer
*Attorney, Agent, or Firm*—Knobbe, Martens, Olson & Bear

[57] ABSTRACT

A microwave detector, which integrates two circular patch antennas with a detector diode. The high impedance at the edge of the circular patch antenna is combined with 180° out of phase electric fields at diametrically opposite points, so as to match to the RF impedance of a zero or small DC bias diode. The result is a very simple, high-sensitivity narrow-band microwave integrated detector.

6 Claims, 2 Drawing Sheets

MICROWAVE INTEGRATED TUNED DETECTOR

FIELD OF THE INVENTION

This invention relates in general to microwave tuned detector-receivers, and more particularly to a low-cost, high-sensitivity microwave tuned receiver which integrates at least two circular patch antennas with a detector diode.

BACKGROUND OF THE INVENTION

Traditional microwave detector designs use resistive terminations to match an RF source. However, the detector diodes used in such designs, when operated unbiased or at a small DC bias, have a relatively high RF resistance and receive only a small fraction of the available signal power when connected in parallel to the resistive termination (e.g. a 50 ohm resistor).

In narrow band applications, high sensitivity tuned detectors are preferred. Impedance transformation and reverse-phasing of the detector diode terminals have been used to increase the sensitivity and output voltage of the resistive termination used in such prior art designs. Nevertheless, both techniques have deficiencies. The first technique makes use of circuit elements such as quarter-wave high impedance transmission lines, which are difficult to achieve with conventional lines. The second technique requires a 180° power divider. The requirement for additional elements to implement these two prior art techniques increases the complexity and size of the detector assembly and introduces extra losses.

SUMMARY OF THE INVENTION

In accordance with the present invention, two closely separated circular patch antennas are provided for receiving the microwave signal. A detector diode is placed in between the two antennas and is connected to their respective adjacent edges. The centre of one antenna is grounded to provide the DC return path for the diode. The centre of the second antenna provides the DC output of the detector.

The integrated tuned detector embodying the present invention takes advantage of both prior art techniques without requiring the use of additional elements. The result is a very simple, high-sensitivity integrated tuned detector.

The detector of the present invention has the following improvements over prior art tuned detectors:

(1) It combines the input power from two antennas resulting in a 6 dB increase in output voltage.

(2) It provides a certain degree (depending on antenna separation) of spatial diversity;

(3) It does not need circuit elements to filter out the high frequency component at the output of the detector;

(4) It does not need circuit elements to provide a DC path for the diode.

Further advances of the microwave detector embodying the invention will be more fully understood from a consideration of the following detailed description in conjunction with the accompanying drawings.

DETAILED DESCRIPTION OF THE PREFERRED EMBODIMENT

Figure 1:
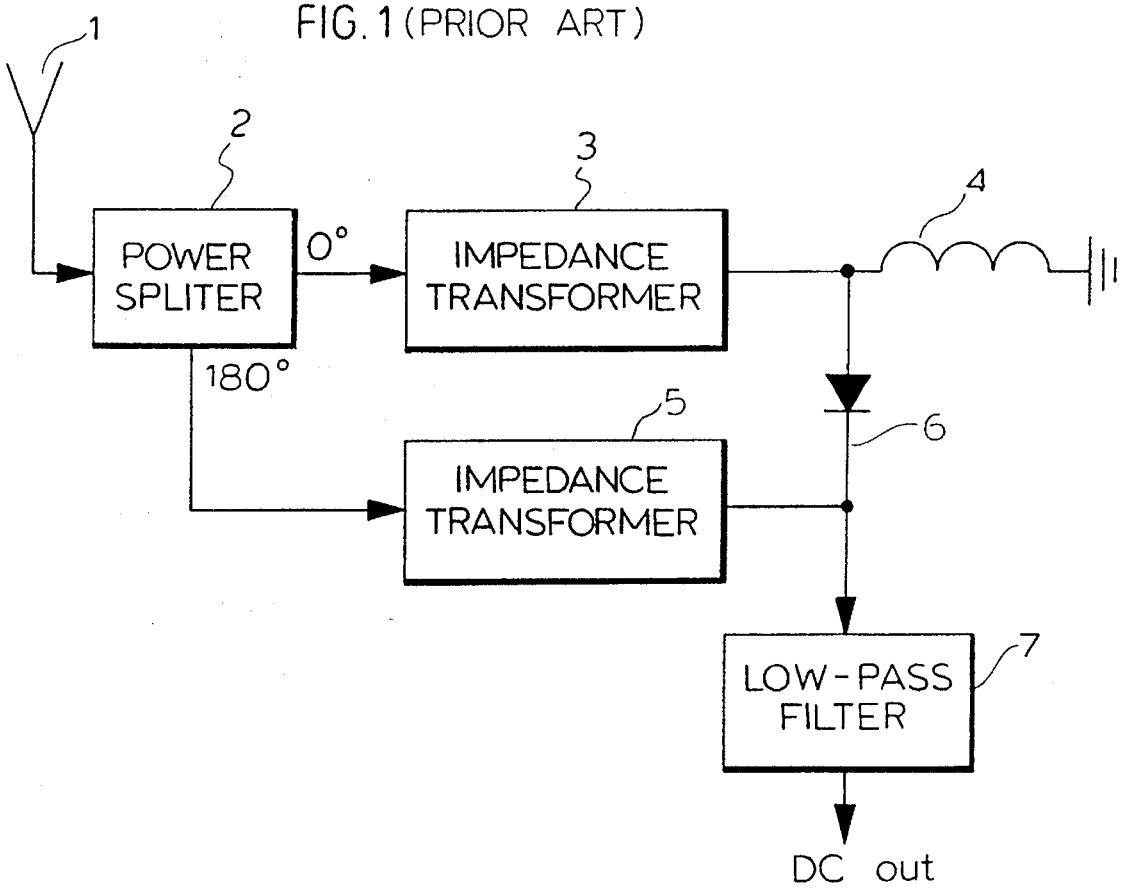
FIG. 1 (PRIOR ART)
FIG. 1 is an equivalent functional diagram of a high-sensitivity integrated tuned detector according to well known design.

FIG. 1 shows the equivalent functional diagram of a high-sensitivity integrated detector. The antenna 1 receives the microwave signal. The power spliter 2 divides the input power evenly and applies it to the impedance transformers 3 and 5, with a 180° phase difference. The impedance transformer 3 raises the impedance to as high a value as is practical and feeds the anode of a Schottky barrier detector diode 6. The impedance transformer 5 provides the same function as the impedance transformer 3 and supplies the cathode of the diode 6. The high frequency component of the detected signal is removed by low-pass filter 7. The inductor 4 provides the DC return path for the diode 6.

These functions may be implemented very simply through the exploitation of well known patch antenna technology.

Figure 2:
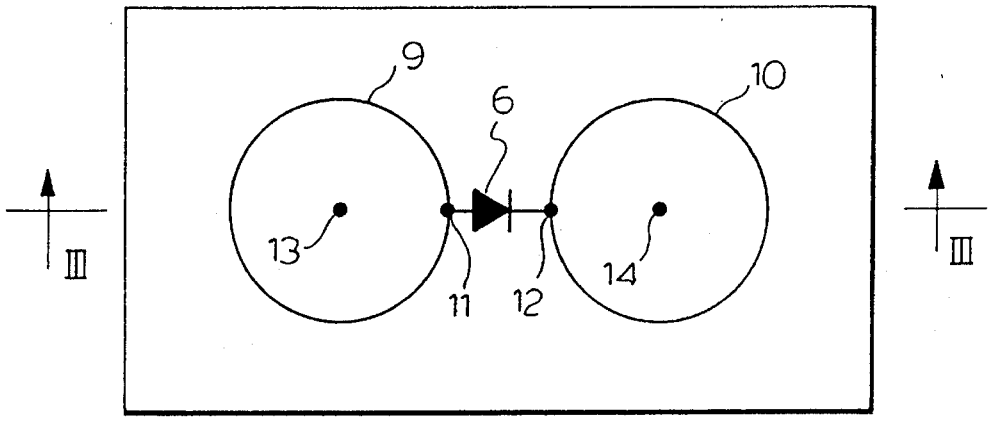
FIG. 2 shows an implementation on microstrip of an integrated tuned detector according to the present invention.
Figure 3:
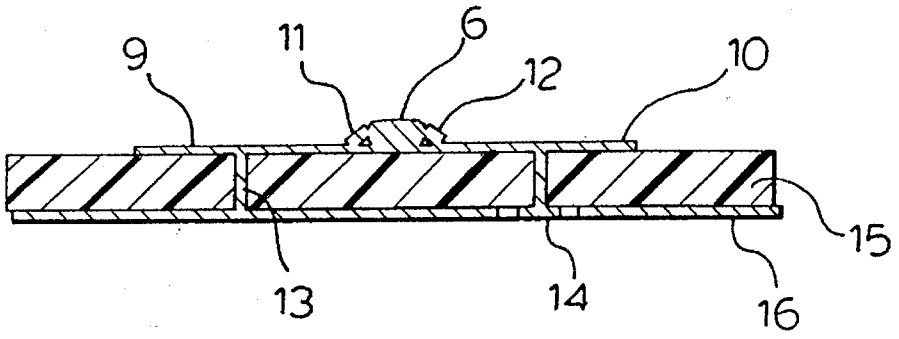
FIG. 3 is a cross-section through the lines III—III in FIG. 2.

FIGS. 2 and 3 show an implementation on microstrip of these functional blocks according to the present invention.

A pair of circular patch antennas 9 and 10 are disposed on a substrate 15, having a ground plane 16 on the opposite side from the antennas patches 9 and 10. The radius of both circular patch antennas 9 and 10 is calculated to excite the dominant $TM_{11}$ mode at any frequency of interest. For this mode, the electrical field is zero at the centre of the patch. However, at diametrically opposite points on the circumference of the patch the electric fields are 180° out of phase. In addition, the impedance at the edge of each patch is very high (i.e. hundreds of ohms.). Further exploiting this knowledge, it is clear that the signals at points 11 and 12 are 180° out of phase (functional block 2 in FIG. 1). Furthermore, because of the high impedance at points 11 and 12, impedance transformation (functional blocks 3 and 5 in FIG. 1) is performed by the antennas themselves.

The electrical field is zero at the centre point 13 of the antenna 9 and therefore it can be grounded to provide the DC return path for the diode 6 (the function of the inductor 4 in FIG. 1).

The DC output signal is present at point 14. Because the field is zero at this point as well, low-pass filtration (block 7 in FIG. 1) is performed by antenna 10. The DC return point 13 and DC output point 14 can be interchanged, thereby producing a DC output with reverse polarity.

Accordingly, the configuration of the present invention results in a high-sensitivity integrated tuned detector utilizing only three elements.

Figure 4:
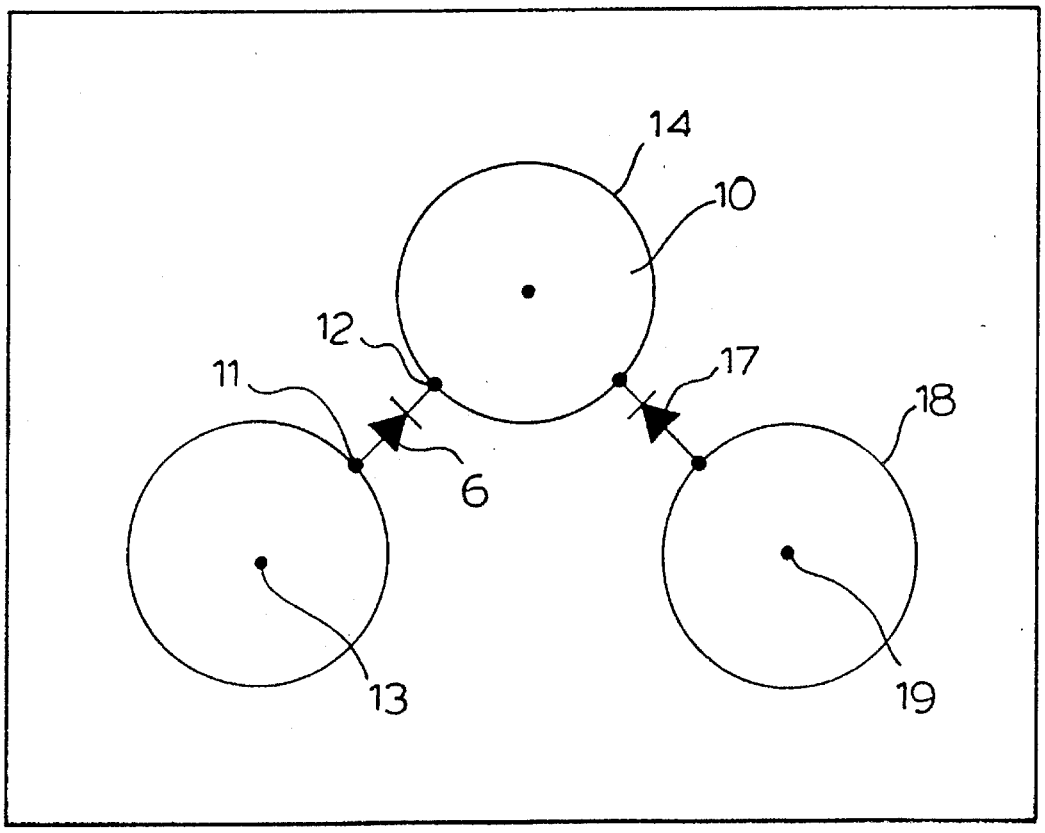
FIG. 4 shows an alternative embodiment in which circuitry for performing polarization diversity has been added.

Alternative variations are possible. In FIG. 4 an example of an integrated tuned detector is shown with polarization diversity. The configuration is essentially a combination of two orthogonal integrated tuned detectors in accordance with the present invention (i.e. by including an additional circular patch antenna 18 with grounded centre 19, and connected to antenna 10 via an additional diode 17). The two detectors of FIG. 4 share the antenna 10, which also acts as diversity combiner.

All such alternative variations are believed to be within the sphere and scope of the present invention as defined by the claims appended hereto.

I claim:

1. A microwave integrated tuned detector for receiving microwave signals in a predetermined frequency range, comprising:

a) a DC output;

b) a substrate;

c) a grounded plane mounted on one side of said substrate;

d) first and second circular patch antennas mounted on an opposite side of said substrate from said grounded plane, said antennas being of predetermined radius for exciting a dominant $TM_{11}$ mode in said predetermined frequency range, said first and second circular patch antennas having respective first and second centers;

e) a detector diode having one terminal thereof connected to said first circular patch antenna, and having an opposite terminal thereof connected to a point on said second circular patch antenna nearest to said first antenna;

f) said center of said first circular patch antenna being connected to said grounded plane for providing a DC return path for said detector diode; and g) said center of said second circular patch antenna being connected to said DC output.

2. The microwave integrated tuned detector of claim 1, wherein said detector diode is a Schottky diode.

3. The microwave integrated tuned detector of claim 2, wherein said Schottky diode is unbiased.

4. The microwave integrated tuned detector of claim 2, wherein said Schottky diode is biased at a DC current.

5. The microwave integrated tuned detector of claim 1, wherein said detector diode is connected to nearest points along respective edges of said first and second circular patch antennas.

6. The microwave integrated tuned detector of claim 1, wherein said detector diode is connected to circumferences of said first and second circular patch antennas along a line through said first and second centers.

* * * * *